US005353936A

United States Patent [19]

Dockstader et al.

[11] Patent Number: 5,353,936

[45] Date of Patent: Oct. 11, 1994

[54] PROTECTIVE TRAY DEVICE FOR PALLETIZED LOADS

[76] Inventors: Randal W. Dockstader, 9724 S. Merrimac, Oak Lawn, Ill. 60453; Richard D. Dockstader, 801 S. Plymouth Ct., Chicago, Ill. 60605

[21] Appl. No.: 148,882

[22] Filed: Nov. 8, 1993

Related U.S. Application Data

[63] Continuation of Ser. No. 908,965, Jul. 6, 1992, abandoned.

[51] Int. Cl.[5] ..... B65D 19/06

[52] U.S. Cl. ..... 206/597; 53/441; 206/386

[58] Field of Search ..... 53/397, 441, 449; 108/55.1; 206/83.5, 386, 497, 526, 595-600

[56] References Cited

U.S. PATENT DOCUMENTS

| | | | |
|---|---|---|---|
| 2,571,748 | 5/1949 | Newman . | |
| 2,762,551 | 5/1954 | Fallert . | |
| 2,913,206 | 7/1956 | Paris . | |
| 3,133,511 | 8/1962 | Phillips . | |
| 3,246,824 | 2/1964 | Gardner . | |
| 3,297,175 | 11/1964 | Gooding . | |
| 3,589,510 | 6/1971 | Begnaud et al. . | |
| 3,670,880 | 6/1972 | Burleson et al. . | |
| 3,746,160 | 7/1973 | Thompson et al. . | |
| 3,945,493 | 3/1976 | Cardinal . | |
| 3,946,883 | 3/1976 | Beal . | |
| 4,042,127 | 8/1977 | Brossia . | |
| 4,383,609 | 5/1983 | Lochmiller . | |
| 4,607,476 | 8/1986 | Fulton, Jr. | 53/441 |
| 4,635,562 | 1/1987 | Kreeger . | |
| 4,741,442 | 5/1988 | Slocumb . | |
| 4,747,252 | 5/1988 | Kapke . | |
| 4,779,396 | 11/1988 | Stackhouse . | |
| 4,876,841 | 10/1989 | Jensen . | |
| 4,879,861 | 11/1989 | McAdams . | |
| 4,898,321 | 2/1990 | Delany . | |
| 4,936,451 | 6/1990 | Shuert . | |
| 5,050,738 | 9/1991 | McAdams . | |

*Primary Examiner*—Jimmy G. Foster
*Attorney, Agent, or Firm*—Welsh & Katz, Ltd.

[57] ABSTRACT

A protective tray for use in a palletized load of stacked packages of material, such as bags of particulate material, prevents the lower packages in the stack from being ripped or torn by the pallet slats in the event the load shifts laterally relative to the pallet and must be pushed back onto the pallet. The protective tray may be made from plastic or from a relatively high strength inexpensive fiberboard blank having fold and score lines enabling assembly of the blank to define a bottom panel and integral upstanding side panels and end members. The side panels and end members are maintained in upstanding relation to the bottom panel by corner retaining flaps. A low-friction sheet, such as heavy gauge paper, is preferably provided between the pallet and the bottom panel of the protective tray to facilitate sliding of the shifted load and protective tray onto the pallet.

11 Claims, 1 Drawing Sheet

PROTECTIVE TRAY DEVICE FOR PALLETIZED LOADS

This is a continuation of application Ser. No. 07/908,965, filed Jul. 6, 1992, now abandoned.

BACKGROUND OF THE INVENTION

The present invention relates generally to palletized loads, and more particularly to a novel protective tray and method of utilizing the tray in a palletized load to prevent damage to stacked bags of particulate material or other packaged products by pallet slats in the event of load shifting during handling or shipping of the palletized load.

It is a common practice in shipping and storing bags of particulate material, such as salt, small stones or rocks, sugar and fertilizer and the like, or other packaged products which lend themselves to palletized shipping and storing, to stack a plurality of the bags or packaged products on a pallet. Pallets used for such purposes typically have a plurality of spaced parallel wooden slats secured transversely to the upper surfaces of at least two runners so as to facilitate pickup and movement of the loaded pallet with a forklift type vehicle. The bags or packaged products may be stacked in a single layer or several layers high on the pallet. While attempts have been made to stabilize the stacked bags relative to the underlying pallet, such as by encircling the stacked bags or packages with a net or mesh, sudden movement of the loaded pallet during handling or transport can result in shifting of the load relative to the pallet. This frequently results in one or more of the bags or other type containers in the bottom layer being ripped open by the side edges or ends of the slats, particularly where the product containers are capable of sagging between the spaced slats. As the load shifts, the bags or containers in the lower layer adjacent the leading edge of the shifted load generally overhang and sag about the longitudinal edge of the outermost slat or about the end edges of a plurality of slats. With heavy loads, this makes it virtually impossible to push the stacked bags or containers back onto the pallet without tearing or ripping the lower overlapping bags or containers, with resultant spillage of the contents. When this occurs, the entire load must be restacked onto another pallet and the contents of the broken or ripped bags or containers either discarded or repackaged. This leads to significant economic loss.

SUMMARY OF THE INVENTION

One of the primary objects of the present invention is to provide a novel and economical protective tray for use in a palletized load of discrete containers, such as bags or containers of particulate material and the like, which overcomes the problems experienced with known palletized loads of packaged products.

A more particular object of the present invention is to provide a novel protective tray and method for utilizing the tray in a palletized load system wherein the protective tray facilitates repositioning of a shifted load of packaged products onto a pallet without ripping or tearing of the containers by the longitudinal or end edges of the pallet slats.

In carrying out the present invention, a protective tray is provided which is preferably made from a relatively high strength fiberboard, such as a double wall corrugated cardboard, or from a relatively rigid plastic.

When made from a fiberboard material, the protective tray may be formed from an integral blank of cardboard foldable to define a bottom panel, upstanding longitudinal side panels and upstanding double panel end members. The side panels and end members are maintained in upstanding relation to the bottom panel by corner retaining flaps. Locking tabs are also preferably formed on free outer edges of the blank end members and cooperate with the bottom panel to maintain the respective pairs of end panels in juxtaposed relation. The protective tray is placed on a pallet with a low-friction sheet, such as heavy gauge paper, between the pallet slats and the bottom panel of the tray. Containers of products, such as bags of particulate material in the form of salt, rocks, dirt, sugar or fertilizer or the like, or other packaged products which lend themselves to palletized shipping and storing, are preferably stacked on the tray with at least the lower layer of containers being disposed within the upstanding side walls and end members of the tray. Preferably, a stretch-type wrap encircles the stacked containers and side walls of the protective tray but does not overlap the pallet. The protective tray prevents tearing or ripping of the lower layer of containers which might sag between the spaced pallet slats, and also facilitates generally horizontal repositioning or sliding of the load back onto the pallet without ripping the lower overhanging containers in the event the load shifts laterally during handling or shipping of the loaded pallet.

Further objects, features and advantages of the present invention, together with its organization and manner of operation, will become apparent from the following detailed description of the invention taken in conjunction with the accompanying drawing wherein like reference numerals designate like elements throughout the several views.

DETAILED DESCRIPTION

Figure 1:
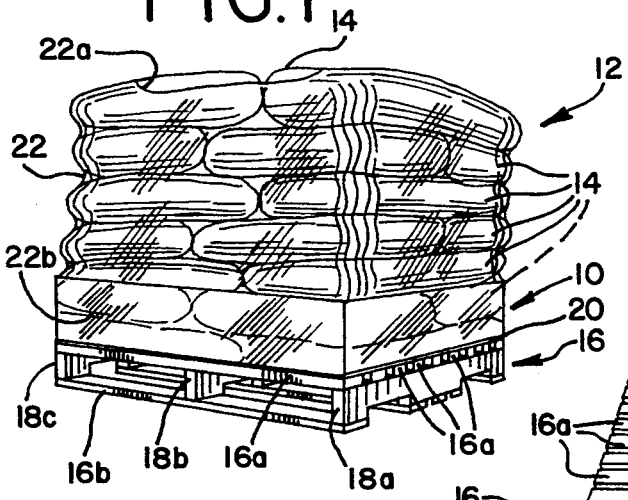
FIG. 1 is a perspective view of a palletized load of bags of particulate material employing a protective tray in accordance with the present invention.

Referring now to the drawing, and in particular to FIG. 1, a protective tray constructed in accordance with one embodiment of the present invention is indicated generally at 10. The protective tray is employed in a palletized load 12 wherein discrete containers of products, such as bags 14 of particulate material in the form of salt, small rocks or stones, dirt, sugar, fertilizer or other particulate or powder material, are stacked in layers on a pallet 16 of conventional design. As will become apparent from the following description, the discrete product containers supported on the protective tray 10 on the pallet 16 may also comprise cartons of products other than particulate material and wherein ripping or tearing of the containers could require repackaging and reloading onto a pallet, and result in loss of product. The pallet 16 includes a plurality of parallel spaced slats 16*a* which are conventionally made of suitable strength wood and are fixed, as by nailing, in transverse relation to two or more runners or stringers, three of which are indicated at 18*a,b* and *c,* also made of wood. The pallet 16 has parallel spaced slats 16*b* fixed in transverse relation to the runners or stringers 18*a–c* opposite the slats 16*a,* thus providing a double-sided reversible pallet. The upper and lower slats 16*a* and 16*b* are spaced apart by the runners 18*a–c* to facilitate entry of the fork tines of a forklift type vehicle to facilitate handling of the loaded pallet. The runners or stringers 18*a–c* are also formed to facilitate entry and lifting of the pallet by a forklift.

In the palletized load illustrated in FIG. 1, a low-friction sheet 20, such as heavy gauge paper, is placed on the upper surfaces of the upwardly facing slats 16*a* between the pallet and the protective tray 10. As will be described, the low-friction sheet 20 provides a relatively low friction surface to facilitate easier lateral sliding of the protective tray than the relatively high-friction surfaces of the bare wooden slats. A stretch-type plastic wrap 22 is preferably wrapped around the outer periphery of the stacked bags 14 so that an upper edge 22*a* of the wrap is curled over the upper outer edges of the upper layer of bags, while the lower edge 22*b* of the wrap overlies the outer periphery of the protective tray 10 but does not overlie the periphery of the pallet 16.

Figure 2:
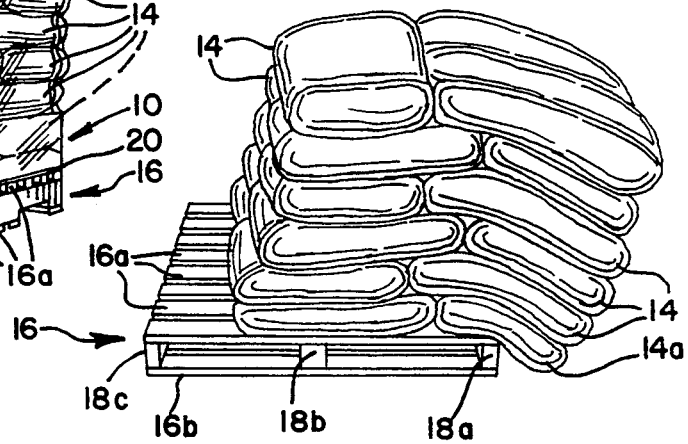
FIG. 2 is a perspective view showing a palletized load of bagged particulate material in accordance with prior practice and wherein the load has shifted relative to the pallet to create a problem of the type overcome by the present invention.

FIG. 2 illustrates a palletized load of bags 14 of particulate material supported on the upwardly facing slats 16*a* of a pallet 16 in accordance with prior conventional practice. The bags 14 are stacked on the pallet without a protective tray 10, a low-friction sheet 20, or a peripheral retaining wrap, such as shown at 22 in FIG. 1. In the palletized load illustrated in FIG. 2, the loaded pallet has been subjected to a lateral force, applied either to the pallet 16 or the stacked load of bags 14, which has caused relative lateral movement between the bags 14 and the pallet. In this situation, the leading edges of the lowermost bags in the stack, such as the right-hand lower bags 14*a,* have shifted sufficiently to overhang and sag about the underlying ends of the pallet slats 16*a.* When the bags of material 14 have shifted in this manner, they must be moved generally laterally back onto the pallet 16. Due to the weight of the stacked bags 14 which sag about the end edges of the pallet slats 16*a,* pushing the bags laterally to reposition them on the pallet 16 is conventionally undertaken by a suitably rigged forklift truck or the like which is capable of lifting the overhanging bags and pushing the full load of bags laterally back onto the pallet. A problem frequently arises in such repositioning in which the lowermost overhanging bags 14*a* are torn or ripped by the edges of the pallet slats, with frequent unintended discharge of at least a portion of the contents of the ripped bags. In this case, the untorn bags must be individually reloaded onto another pallet and the contents of the torn or ripped bags must be rebagged or discarded. In any event, substantial time is lost in restacking the undamaged bags onto the pallet, rebagging of the contents of the ripped or torn bags, and cleanup of any spilled contents, all of which leads to significant economic loss.

Similarly, if the pallet and load as shown in FIG. 2 are subjected to relative lateral forces so that the bagged material moves in a position generally transverse to the pallet slats 16*a,* any of the bags in the lowermost layer which have sagged between the spaced pallet slats may be torn or ripped by the longitudinal edges of the slats upon sudden movement of the bags relative to the slats. This contributes further to the aforedescribed problem of restacking the shifted bags and rebagging or discarding spilled contents.

Figure 4:
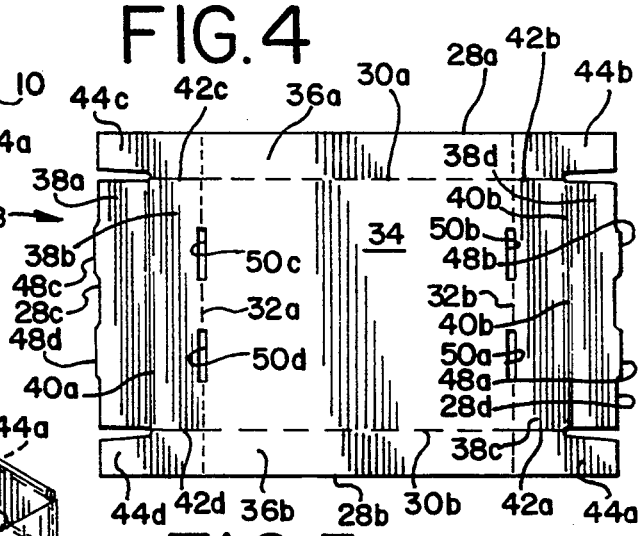
FIG. 4 is a plan view of a blank from which the protective tray illustrated in FIG. 3 is made.
Figure 3:
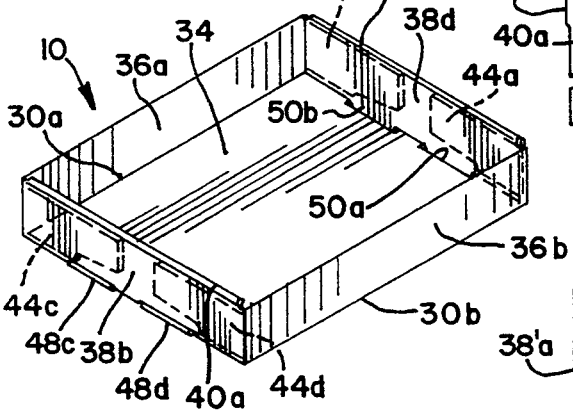
FIG. 3 is a perspective view of the protective tray employed in the palletized load of FIG. 1 and as made from a blank as shown in FIG. 4.

Referring to FIGS. 3 and 4, the protective tray 10 is made from a blank of fiberboard material of suitable strength to provide desired rigidity and strength characteristics for use in the palletized load 12. In the embodiment illustrated in FIGS. 3 and 4, a die-cut blank 28 of 275 pound double-sided corrugated cardboard has a generally rectangular plan configuration and is suitably scored and impressed to create retaining flaps and define fold or hinge lines in the blank. Referring to FIG. 4, the blank 28 is formed with longitudinal fold or hinge lines, indicated by dash lines 30*a* and 30*b,* which are parallel to and spaced equally from corresponding outer longitudinal edges 28*a* and 28*b* of the blank. Transverse fold or hinge lines represented by dash lines 32*a* an 32*b,* are formed parallel to and spaced equally from corresponding transverse outer end edges 28*c* and 28*d* of the blank 28. The fold lines 30*a,b* and 32*a,b* define the perimeter of a rectangular bottom panel 34 of the protective tray 10 and also establish longitudinal laterally opposite side panels 36*a* and 36*b* and opposite end members comprising pairs of panels 38*a,b* and 38*c,d* which are integrally hingedly connected along respective fold lines 40*a* and 40*b.* Die cuts, indicated at 42*a–d,* establish retaining flaps 44*a–d* on the opposite ends of the side panels 36*a* and 36*b.* A pair of locking tabs are formed along each of the transverse outer marginal edges 28*c* and 28*d* of the blank 28, such as indicated at 48*a–d.*

In assembling or folding the blank 28 into the protective tray 10, the side panels 36*a,b* are folded upwardly about the fold lines 30*a* and 30*b,* respectively, into upstanding normal relation to the bottom panel 34. The retaining flaps 44*a–d* are then folded inwardly about their respective hinge or fold lines 32*a,b* to right-angle positions relative to the side panels. The end members are then folded upwardly such that their inner panels 38*b* and 38*c* lie outwardly of the corresponding retaining flaps 44*a,b* and 44*c,d,* and the outer panels 38*a* and 38*d* are folded about their corresponding fold lines 40*a* and 40*b* to lie in juxtaposed relation to panels 38*b* and 38*c,* respectively. The locking tabs 48*a–d* on the free edges of panels 38*a,d* are inserted within rectangular slits or openings 50*a,b* formed generally along the fold lines 32*a* and 32*b,* thereby capturing the retaining flaps 44*a–d* between the pairs of end panels 38*a,b* and 38*c,d.* In this manner, upstanding sides extend about the perimeter of the bottom panel 34, as illustrated in FIG. 3. In a preferred embodiment, the bottom panel has an area substantially equal to the support area of the pallet slats, such as approximately 48 inches long by 40 inches wide, and the side and end walls are approximately 8 inches high.

Figure 5:
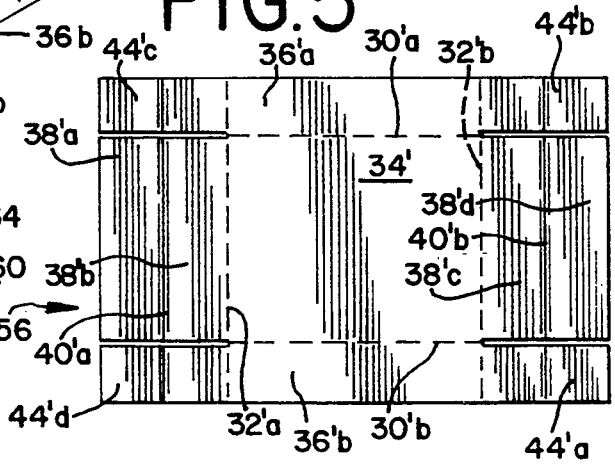
FIG. 5 is a plan view of a blank for forming an alternative protective tray for pallet loads in accordance with the present invention.
Figure 6:
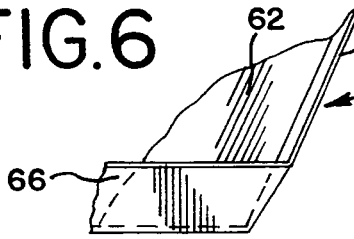
FIG. 6 is a fragmentary perspective view illustrating an alternative protective tray made from plastic and having outwardly tapered side and end walls to facilitate nesting.

FIG. 5 illustrates an alternative blank of suitable strength fiberboard, indicated generally at 56, which is generally similar to the blank 28 and may be assembled into a protective tray similar to tray 10. The various elements of the blank 56 which correspond to similar elements of the blank 28 are designated by corresponding but primed reference numerals. Thus, it is seen that the rectangular blank 56 has suitable longitudinal and transverse fold lines 30'*a,b* and 32'*a,b* which establish a rectangular bottom panel 34', laterally opposite side panels 36'*a,b,* end members comprising integrally hinged panels 38'*a,b* and 38'*c,d,* and retaining flaps 44'*a–d.* The primary difference between the blank 56 and the blank 28 is that in folding the blank 56 into a protective tray with the retaining flaps 44'*a–d* captured between the corresponding juxtaposed end panels 38'*a,b* and 38'*c,d,* the outer end panels 38'*a* and 38'*d* are maintained in their inwardly folded positions through frictional engagement of the outer marginal edges 28'*c* and 28'*d* with the bottom panel 34'.

Figure 7:
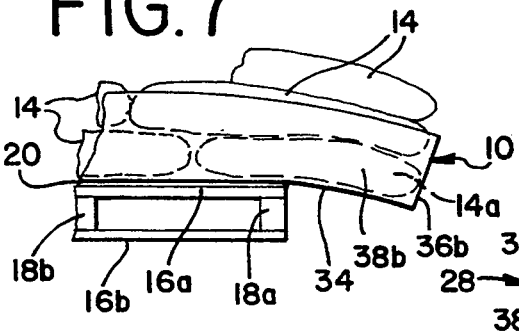
FIG. 7 is a fragmentary elevational view illustrating how the protective tray of the invention protects the lower bags when the load of bags has shifted relative to the pallet.

An advantage of making the protective tray 10 from a fiberboard blank, such as the described blanks 28 and 56, is that a very economical protective tray can be provided which may be disposed of after a single use or multiple uses in conjunction with palletized loads of the type illustrated in FIG. 1. However, a protective tray in accordance with an alternative embodiment of the invention may be made from a suitable strength plastic, as by injection molding. FIG. 7 is a fragmentary view of a protective tray, indicated generally at 60, which is formed from a suitable strength plastic having a wall thickness approximately equal to the thickness of the fiberboard or cardboard blanks 28 and 56 and having a rectangular bottom panel 62 substantially similar in size to the bottom panel 34 of the protective tray 10. Formed integral with the bottom panel 62 and extending about the full rectangular periphery thereof are upstanding side walls, one of which is indicated at 64, and opposite end walls, one of which is indicated at 66. The side walls 64 and end walls 66 are integrally connected both to the bottom panel 62 and to each other at their intersecting corners. The side walls 64 and end walls 66 are preferably inclined generally equally outwardly from planes normal to the bottom panel 62 so as to form outward angles of incline of approximately 10–15 degrees. In this manner, a plurality of the protective trays 60 could be stacked in nested relation to facilitate shipping and storage preparatory to use in palletized loads.

Referring to FIG. 7, when the protective tray 10 is disposed on the upper slats 16*a* of a pallet 16 with a low-friction sheet 20 interposed between the slats and the bottom panel 34 of the protective tray, and with bags 14 of particulate or powder material stacked upwardly on the protective tray, lateral shifting of the load of bags 14 relative to the pallet 16 will effect a corresponding movement of the tray 10 so that the lower bags 14 in the stack which overhang the edge of the pallet are maintained within the protective tray. The protective tray enables the load of bags 14 to be moved back onto the pallet with the protective tray protecting the lower bags from being ripped or torn by the edges of the pallet slats 16*a.* It has been found that lifting the overhanging portion of the protective tray and corresponding load, as by a forklift, to a height slightly higher than the upper surface of the pallet enables the protective tray and load to be readily pushed back onto the pallet. The low-friction sheet 20 facilitates sliding of the protective tray on the pallet slats 16*a.*

It will thus be appreciated that the protective tray in accordance with the present invention provides significant economic savings by eliminating or substantially reducing tearing or ripping of bags of particulate material stacked on a pallet in a palletized load in the event of lateral load shifting of the load during handling or storage.

While preferred embodiments of the protective tray in accordance with the present invention have been illustrated and described, as well as the method of its use in a palletized load, it will be understood that changes and modifications may be made therein without departing from the invention in its broader aspects. Various features of the invention are defined in the following claims.

What is claimed is:

1. A palletized load system comprising, in combination, a pallet having an upwardly facing support surface defined by spaced apart slats, a sheet of relatively low-friction material disposed on said pallet support surface and substantially covering same, a protective tray supported on said low-friction sheet, said protective tray having a bottom panel substantially equal in area to said pallet support surface and having upstanding side and end panels secured to an outer rectangular periphery of said bottom panel in generally upstanding relation thereto, a load supported on said bottom panel of said protective tray so as not to extend laterally outwardly substantially beyond the planes of the side and end panels, said load comprising a plurality of packages of material, and an outer wrap extending about the periphery of said load and protective tray, said wrap overlying said upstanding side and end panels of said protective tray and at least partially overlapping the uppermost stacked packages but not overlying said pallet, said protective tray being laterally movable with the load when subjected to lateral movement relative to the pallet and being operative to substantially prevent tearing of said packages by said slats when the load and tray are moved laterally to reposition the load on the pallet.

2. A palletized load system as defined in claim 1 wherein the upstanding side and end panels of said protective tray are dimensioned to extend above the height of the lowermost layer of packages.

3. A palletized load system as defined in claim 1 wherein said protective tray is made from fiberboard, said end panels comprising pairs of generally equal size inner and outer panels hingedly interconnected to said bottom panel and foldable to juxtaposed relation, said side panels having retaining flaps captured between said juxtaposed inner and outer panels to maintain said side and end panels in upstanding relation to said bottom panel.

4. A palletized load system as defined in claim 3 wherein said protective tray is made of plastic, and wherein said side and end panels are inclined outwardly relative to planes normal to said bottom panel.

5. A palletized load system as defined in claim 3 wherein said outer end panels have locking tabs operative to be inserted within retaining slots formed in said bottom panel when said end panels are folded into said juxtaposed and upstanding relation to said bottom panel.

6. A method of creating a palletized load of packaged material on a pallet having a generally rectangular upwardly facing support surface defined by generally parallel spaced slats, said method comprising the steps of:

placing a sheet of low-friction material on the pallet slats so as to substantially cover the pallet support surface, placing a protective tray on the low-friction sheet, said protective tray having a rectangular bottom panel of a size substantially equal to the pallet support surface, laterally opposite upstanding side panels integral with said bottom panel, and upstanding end members integral with said bottom panel and interconnected to said side panels so as to establish upstanding corners between said side panels and end members;

placing a plurality of packages of material on the bottom panel of the protective tray in generally stacked relation so that the packages do not extend laterally outwardly substantially beyond the planes of the side panels and end members;

and applying a wrap circumferentially about the stacked packages so that a lower edge of the wrap overlies at least a portion of the tray side panel and end members but does not overlie the pallet, and an upper edge of the wrap at least partially overlaps the uppermost stacked packages, said protective tray being operative to move laterally with the stacked packages when subjected to lateral shifting relative to the pallet, and being adapted to prevent tearing of the lowermost packages in the stack by the slats upon lateral movement of the tray and stacked packages to reposition them on the pallet support surface.

7. The method as defined in claim 6 wherein said sheet of low-friction material comprises heavy gauge paper.

8. The method as defined in claim 6 wherein said protective tray is made from a double wall corrugated cardboard.

9. The method of claim 6 wherein said protective tray is made from injection molded plastic such that said side panels and end members taper outwardly from planes normal to the bottom panel.

10. The method of claim 6 wherein said protective tray is made from a unitary rectangular blank of corrugated type cardboard having longitudinal and transverse fold lines defining a rectangular bottom panel, laterally opposite side panels integral with said bottom panel, and end members defined by pairs of hingedly connected substantially equal size inner and outer end panels integral with said bottom panel, said side panels being folded to positions substantially normal to said bottom panel, and said end panels being folded to positions wherein the outer end panels lie in juxtaposed relation to the corresponding inner panels and in normal relation to said bottom panel, said end members and said end panels having mutually cooperating retaining flap means operative to maintain said side panels and end members in upstanding relation to said bottom panel.

11. The method as defined in claim 10 wherein said mutually cooperating retaining flap means includes a retaining flap formed on each of the opposite ends of said side panels, said retaining flaps being foldable to positions captured between said juxtaposed end panels.

* * * * *

UNITED STATES PATENT AND TRADEMARK OFFICE

CERTIFICATE OF CORRECTION

PATENT NO. : 5,353,936

DATED : October 11, 1994

INVENTOR(S) : Dockstader et al.

It is certified that error appears in the above-identified patent and that said Letters Patent is hereby corrected as shown below:

Column 7, line 22, "panel" should be --panels--:

Signed and Sealed this

Fourteenth Day of February, 1995

Bruce Lehman

*Attest:*

BRUCE LEHMAN

*Attesting Officer*

*Commissioner of Patents and Trademarks*